United States Patent [19]

Munson et al.

[11] 4,416,455

[45] Nov. 22, 1983

[54] INTERLOCKING WORD GAME UTILIZING PRISMATIC BLOCKS AND METHOD OF PLAYING SAME

[75] Inventors: Leo J. Munson, Van Nuys; Felix Griauzde, San Pedro; David T. Okada, Manhattan Beach, all of Calif.; Bernard Loomis, New York, N.Y.

[73] Assignee: CPG Products Corp., Minneapolis, Minn.

[21] Appl. No.: 306,989

[22] Filed: Sep. 30, 1981

[51] Int. Cl.[3] ..... A63F 3/00

[52] U.S. Cl. ..... 273/272; 273/150; 273/282; 273/288; 434/172

[58] Field of Search ..... 273/272, 294, 156, 150; 434/172; 273/282, 288, 291

[56] References Cited

U.S. PATENT DOCUMENTS

| | | | |
|---|---|---|---|
| 1,569,701 | 1/1926 | Bostrom | 273/150 |
| 2,327,471 | 8/1943 | Tiers | 434/172 |
| 3,606,336 | 9/1971 | Krause | 273/272 |
| 3,716,236 | 2/1973 | Pangborn | 273/150 |
| 4,360,347 | 11/1982 | Ghaznavi | 273/157 R |

FOREIGN PATENT DOCUMENTS

| | | | |
|---|---|---|---|
| 1174184 | 11/1958 | France | 273/156 |
| 259924 | 11/1927 | United Kingdom | 273/156 |
| 747598 | 4/1956 | United Kingdom | 273/272 |

*Primary Examiner*—Anton O. Oechsle

*Attorney, Agent, or Firm*—Gene O. Enockson; L. MeRoy Lillehaugen; Stuart R. Peterson

[57] ABSTRACT

Prismatic blocks having a triangular cross section are provided with letters and scoring numerals on two faces thereof. In forming words, the players position the blocks in a grid having rectangular openings therein so that only one of the lettered faces is visible. The scoring numeral on one face of each block is contained in a box, whereas the scoring numeral on the other lettered face is unboxed. The highest score wins the game. However, the players can earn extra or bonus points by combining the blocks in prescribed patterns, such as words of at least a certain length containing all boxed numerals or all unboxed numerals.

23 Claims, 14 Drawing Figures

INTERLOCKING WORD GAME UTILIZING PRISMATIC BLOCKS AND METHOD OF PLAYING SAME

BACKGROUND OF THE INVENTION

1. Field of the Invention

This invention relates generally to interlocking word games, and pertains more particularly to such a game and method employing prism-configured blocks having letters and scoring values on two faces thereof.

2. Description of the Prior Art

Numerous word games have been devised with various degrees of challenge and skill associated therewith. Perhaps the closest prior art is to be found in U.S. Pat. No. 2,752,158 granted to James Brunot et al on June 26, 1956 for "GAME APPARATUS". This patent recognizes the difficulty existing with a game of the type described in said patent in that certain discrete areas or squares are marked with scoring directions which are obscured when the playing piece or tile covers that particular area or square. The problem is overcome in the patented apparatus by having the board formed with criss-crossing strips that project from the general plane of the board, the criss-crossing strips having so-called pips, actually small notches, which unobstructively signify the bonus value to be assigned to the score when a playing piece or tile has been placed on that particular square. However, any scoring information is limited by the restricted number of pips that can be employed. In this regard, two pips indicate that the score should be doubled for that square; three pips indicate that the score should be tripled.

SUMMARY OF THE INVENTION

Generally, an object of our invention is to provide an interlocking word game that will be more challenging than in the past, involving a decision-making task not heretofore believed present in games previously devised. More specifically, an aim of the invention is to provide blocks or playing pieces involving two sides or faces, each of the two faces having a particular letter and scoring value thereon. The player must make a choice when selecting a particular side or face so as to maximize the overall scoring value to be derived from the use of that particular face in combination with other selections, for once played, he no longer can avail himself of the other lettered face and the individual numerical score value assigned thereto.

Another object of the invention is to provide a word game of the above character which provides various bonus values, depending upon the word length and also whether the word is composed exclusively of "boxed" letters or "unboxed" letters. In this regard, each numerical value associated with each letter either has a surrounding rectangular box or line or has no such box or line. If the player is to be successful in spelling words of a certain length that make use of all boxed values or all unboxed values, then he is entitled to certain bonus points which add to his overall score.

Another object is to provide a playing board in the form of a simple grid that does not require any legends or scoring indicia thereon.

A further object of the invention is to provide a board or grid that can be made inexpensively. More specifically, it is contemplated that the board or grid be formed of molded plastic.

Still further, an object of the invention is to provide an interlocking word game which not only can be made inexpensively but which also will be quite attractive, both before any blocks have been placed on the grid and also by reason of the uniform spacing resulting from the positioning of the various blocks in the formation of various words.

Yet another object of the invention is to provide a grid and specially configured playing blocks for use therewith which blocks will be firmly, although releasably, held in place. In this respect, an aim of the invention is to provide prismatic blocks having three acutely angled faces thereon, either two of which can be selectively placed uppermost in the grid. When so placed, two sides or faces thereof extend downwardly and are prevented from inadvertent shifting. Hence, our invention will find especial utility when traveling on trips where the apparatus may be supported on uneven surfaces or is likely to be handed from player to player. Any undesired spilling of the playing pieces due to jarring or mishandling is for all intents and purposes obviated when practicing our invention.

Also, the invention has for an object the provision of a grid in which prismatic blocks are placed, the grid being constructed so that it is relatively rigid and rugged by virtue of the structure used to hold in place the various prismatic blocks. Also, it is within the purview of our invention to permit the blocks to be readily grasped and moved from a specially configured rack into the specially configured grid, the positioning of an individual block being facilitated in that the space containing the particular letter thereon that is to remain visible projects upwardly above the general plane of the grid. This same feature enables the various blocks or playing pieces to be removed when the game is over.

Briefly, our invention envisages a word game for two, three or four players, although it can be played by a single player. The playing procedure involves the forming of interlocking words in a cross-word fashion. This is accomplished with a reticulated game board having numerous cavities or openings therein with a readily discernible centrally disposed wedge-shaped pocket that must have placed therein a block providing a letter in the first word. A rack is provided for each player which holds a given number of prismatic blocks so that the two faces thereof having letters and numerical scoring values thereon can be simultaneously viewed, enabling the player to make a choice as to which block and which face of that particluar block is to be used in the spelling of a word. The precise scoring value, while different for various letters, is always of the same numerical value for any given letter. However, the scoring value is boxed or unboxed, all of the boxed values being on an angled face at the left side of each prismatic block and all of the unboxed values being on the right hand face. The third face is left blank, being both letterless and numberless, and is concealed during the various plays, whether the block is on the player's rack where the blocks are arranged so that both of their lettered faces are exposed or on the playing grid where but one lettered face remains visible. In essence, each player competes for the highest score possible by using his letters in combinations that take the best possible advantage of the numerical values assigned to the various letters, together with the additional rewards or bonuses for word lengths and patterns.

BRIEF DESCRIPTION OF THE DRAWINGS

FIG. 8 is a collective view of a number of paired letters and the boxed and unboxed values associated therewith, the view of each pair of lettered faces being developed so that they reside in a single plane in contradistinction to the acutely angled planes that they actually reside in;

DESCRIPTION OF THE PREFERRED EMBODIMENT

Figure 1:
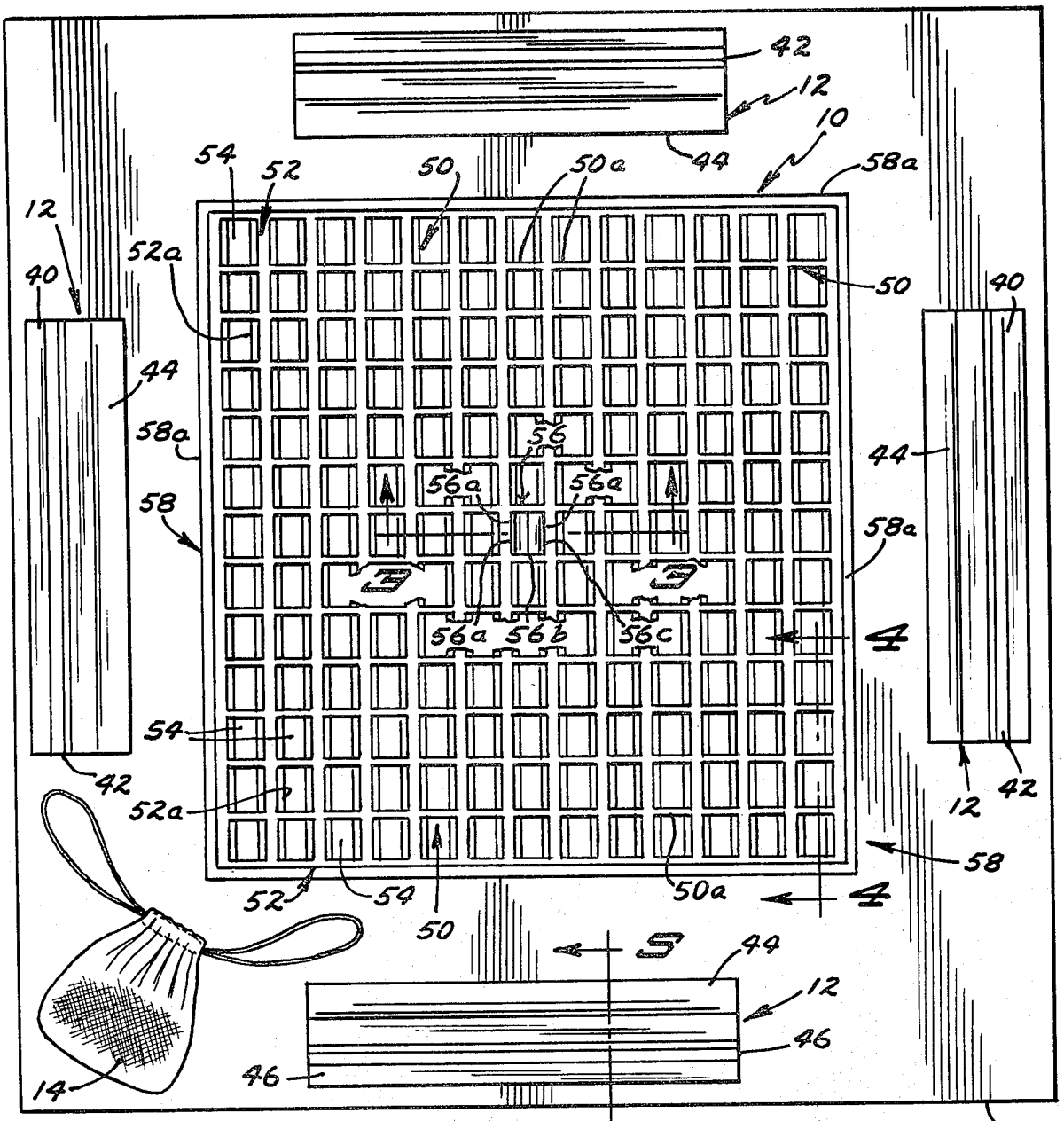
FIG. 1 is a top plan view of the playing grid and four racks used in the playing of our word game, these items having been placed on a conventional table.
Figure 3:
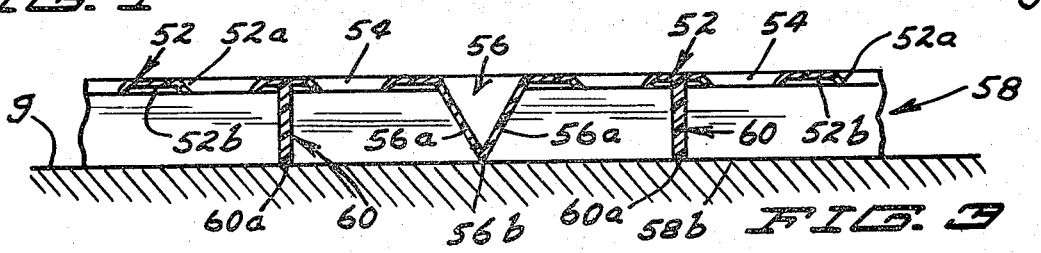
FIG. 3 is an enlarged detailed sectional view through the centrally located wedge-shaped pocket, the view being in the direction of line 3—3 of FIG. 1 and including several cavities or openings to either side of the wedge-shaped pocket.
Figure 4:
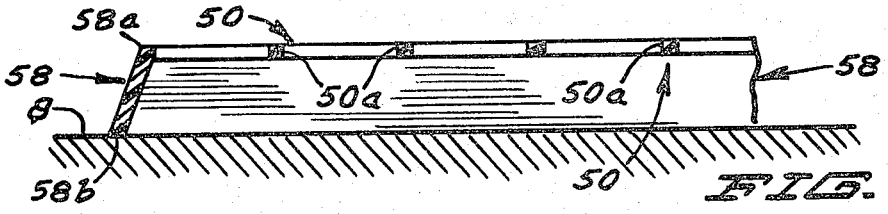
FIG. 4 is a sectional detail taken in the direction of line 4—4 of FIG. 1, the view being on the same scale as FIG. 3.

Referring initially to FIG. 1, it will be seen that a table 8 has been depicted having our game board, more specifically in the form of a grid 10, placed thereon, together with four racks 12 (one for each of four players). If two players are participating, then just two racks 12 would be used; similarly, if three players are participating in the game, three racks 12 would be made use of. It is contemplated that a flexible bag 14 will be used containing a plurality of blocks 16 in the form of five-sided prisms (see FIGS. 6 and 7) where one such block is illustrated.

Inasmuch as the prismatic blocks 16 play an important role as far as our invention is concerned, it will be well at this stage to describe one of the blocks 16 in detail. Preferably, the blocks 16 are formed from hard wood but an appropriate plastic would also be suitable. Therefore, it is to be noted that the block 16 appearing in FIGS. 6 and 7, as well as all of the other blocks, have a left face or side 18 (as viewed in FIG. 6), a right face or side 20 (as viewed in FIG. 6) and a back face or side 22. These faces 18, 20 and 22 are square and are disposed at an acute angle with respect to each other, more specifically, 60°. Additionally, the prismatic block 16 has triangularly configured ends or additional faces 24 and 26 which reside in spaced parallel planes.

The left face 18 (FIG. 6) has a letter 28 thereon as well as a numeral labeled 30 in the form of an exponent having a basic scoring value of "1" with a mark or line in the form of a box 32 enclosing the numeral 30. In a similar fashion, the right face 20 (FIG. 6) has a letter 34 thereon with a raised exponent or numeral 36 with a basic scoring value of "4" having no line or box enclosing it. In one instance, the left face 18 has an asterisk 38 (see FIG. 8 and the tabulation on the next page) thereon and in a second situation the right face 20 has an asterisk or star 38 (see the tabulation on the next page) thereon.

Figure 8:
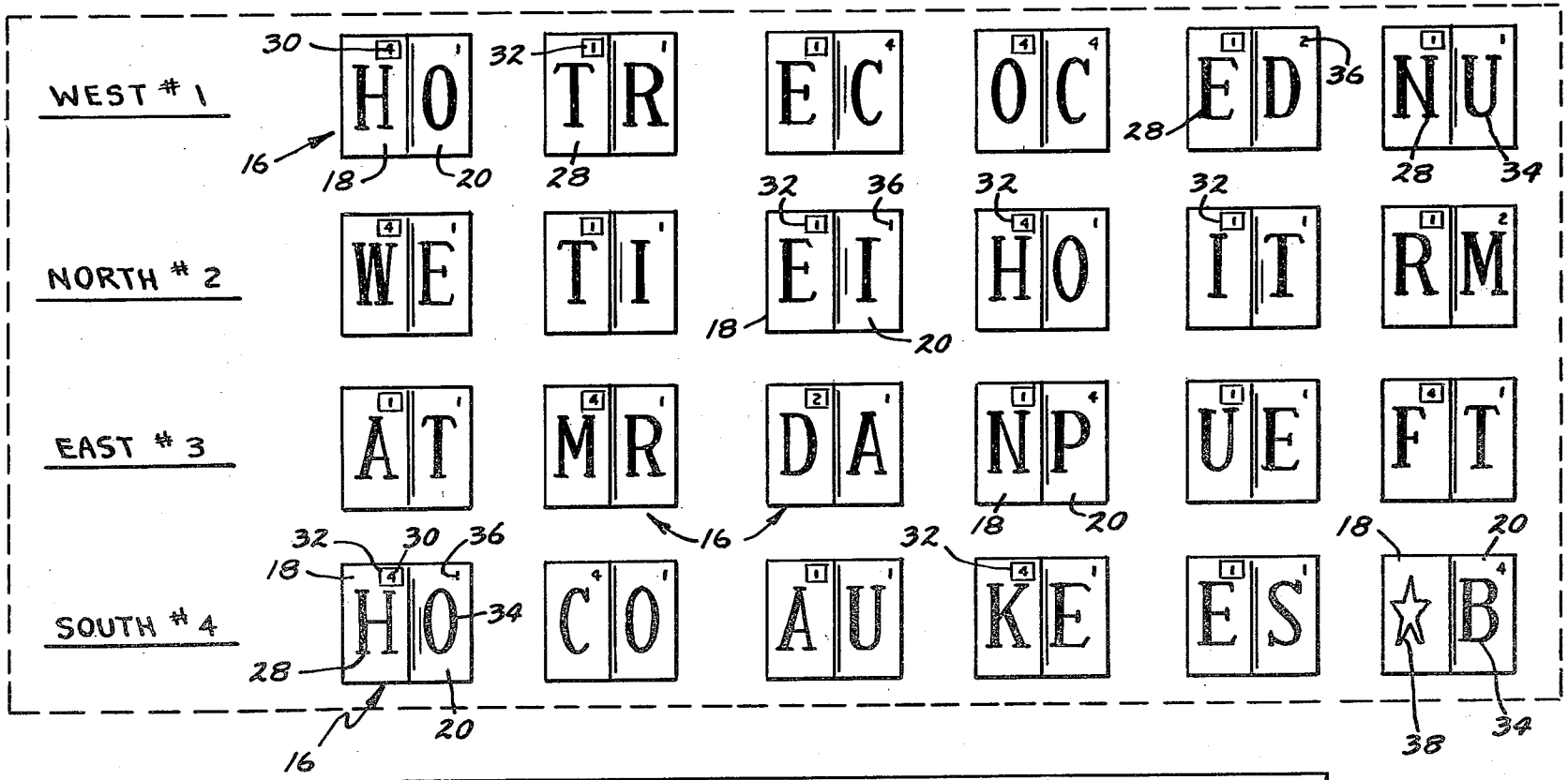

Inasmuch as it is planned that there will be 96 blocks having 95 letters with boxed numerals, 95 letters with unboxed numerals and two asterisks (or stars), it can readily be seen that it is not necessary to show all 96 blocks in the drawings. Nonetheless, FIG. 8 depicts a representative number of blocks 16. As the description progresses, it will be appreciated that there are 192 total letter possibilities. It will be well, in order to appreciate the challenge associated with our word game, to set forth the pairing of the letters, together with the boxed and unboxed numerals representing values to be tallied when scoring various words formed during the course of playing the game. Those letters more commonly found in dictionary words have been duplicated more than those less frequently encountered; also, the more commonly found letters have been assigned lower values for scoring. This will be evident in the following tabulation:

| Block Tabulation | | |
|---|---|---|
| $A^{\boxed{1}}:D^{2}$ | $H^{\boxed{4}}:N^{1}$ | $P^{\boxed{4}}:N^{1}$ |
| $A^{\boxed{1}}:G^{4}$ | $H^{\boxed{4}}:O^{1}$ | $P^{\boxed{4}}:O^{1}$ |
| $A^{\boxed{1}}:M^{2}$ | $I^{\boxed{1}}:D^{2}$ | $Q^{\boxed{9}}:I^{1}$ |
| $A^{\boxed{1}}:S^{1}$ | $I^{\boxed{1}}:F^{4}$ | $R^{\boxed{1}}:G^{4}$ |
| $A^{\boxed{1}}:T^{1}$ | $I^{\boxed{1}}:J^{6}$ | $R^{\boxed{1}}:L^{1}$ |
| $A^{\boxed{1}}:U^{1}$ | $I^{\boxed{1}}:L^{1}$ | $R^{\boxed{1}}:M^{2}$ |
| $A^{\boxed{1}}:V^{4}$ | $I^{\boxed{1}}:T^{1}$ | $R^{\boxed{1}}:S^{1}$ |
| $A^{\boxed{1}}:Z^{9}$ | $I^{\boxed{1}}:Q^{9}$ | $R^{\boxed{1}}:T^{1}$ |

-continued

| Block Tabulation | | |
|---|---|---|
| $B^{\boxed{4}}:*$ | $I^{\boxed{1}}:U^1$ | $R^{\boxed{1}}:W^4$ |
| $B^{\boxed{4}}:E^1$ | $I^{\boxed{1}}:Y^4$ | $S^{\boxed{1}}:A^1$ |
| $C^{\boxed{4}}:E^1$ | $J^{\boxed{6}}:I^1$ | $S^{\boxed{1}}:E^1$ |
| $C^{\boxed{4}}:O^1$ | $K^{\boxed{4}}:E^1$ | $S^{\boxed{1}}:O^1$ |
| $D^{\boxed{2}}:A^1$ | $L^{\boxed{1}}:I^1$ | $S^{\boxed{1}}:R^1$ |
| $D^{\boxed{2}}:E^1$ | $L^{\boxed{1}}:N^1$ | $T^{\boxed{1}}:A^1$ |
| $D^{\boxed{2}}:I^1$ | $L^{\boxed{1}}:O^1$ | $T^{\boxed{1}}:E^1$ |
| $D^{\boxed{2}}:O^1$ | $L^{\boxed{1}}:R^1$ | $T^{\boxed{1}}:I^1$ |
| $E^{\boxed{1}}:B^4$ | $M^{\boxed{2}}:A^1$ | $T^{\boxed{1}}:N^1$ |
| $E^{\boxed{1}}:C^4$ | $M^{\boxed{2}}:R^1$ | $T^{\boxed{1}}:O^1$ |
| $E^{\boxed{1}}:D^2$ | $N^{\boxed{1}}:H^4$ | $T^{\boxed{1}}:R^1$ |
| $E^{\boxed{1}}:G^4$ | $N^{\boxed{1}}:L^1$ | $U^{\boxed{1}}:A^1$ |
| $E^{\boxed{1}}:K^4$ | $N^{\boxed{1}}:P^4$ | $U^{\boxed{1}}:E^1$ |
| $E^{\boxed{1}}:S^1$ | $N^{\boxed{1}}:T^1$ | $U^{\boxed{1}}:I^1$ |
| $E^{\boxed{1}}:T^1$ | $N^{\boxed{1}}:U^1$ | $U^{\boxed{1}}:N^1$ |
| $E^{\boxed{1}}:U^1$ | $N^{\boxed{1}}:X^9$ | $V^{\boxed{4}}:A^1$ |
| $E^{\boxed{1}}:V^4$ | $O^{\boxed{1}}:C^4$ | $V^{\boxed{4}}:E^1$ |
| $E^{\boxed{1}}:W^4$ | $O^{\boxed{1}}:D^2$ | $W^{\boxed{4}}:E^1$ |
| $E^{\boxed{1}}:Y^4$ | $O^{\boxed{1}}:F^4$ | $W^{\boxed{4}}:R^1$ |
| $F^{\boxed{4}}:E^1$ | $O^{\boxed{1}}:H^4$ | $X^{\boxed{9}}:N^1$ |
| $F^{\boxed{4}}:O^1$ | $O^{\boxed{1}}:L^1$ | $Y^{\boxed{4}}:E^1$ |
| $G^{\boxed{4}}:A^1$ | $O^{\boxed{1}}:P^4$ | $Y^{\boxed{4}}:I^1$ |
| $G^{\boxed{4}}:E^1$ | $O^{\boxed{1}}:S^1$ | $Z^{\boxed{9}}:A^1$ *:$B^4$ |
| $G^{\boxed{4}}:R^1$ | $O^{\boxed{1}}:T^1$ | |

Describing now the construction of the racks 12, each of which is a replica of the other, it will be noted that each is literally a shell having a sloping front wall 40 which wall includes a lower panel 40*a* and an upper panel 40*b*, the wall also containing therein a horizontal groove 42 formed by a bottom ledge 42*a*, a rear or back panel 42*b* and an upper or overhanging ledge 42*c*. The rack 12 in each instance includes a sloping rear wall 44 and triangularly configured end walls 46 and an open bottom 48. The racks 12 can be molded from a suitable plastic material.

As far as the game board is concerned, it has already been pointed out that this board is in the form of a grid 10. More specifically, the grid 10 is comprised of intersecting or criss-crossing ribs 50 and 52. The ribs 50 have parallel vertical sides 50*a*, whereas the ribs 52, which are wider than the ribs 50, have angled sides 52*a* which form a recess 52*b* on the under side thereof. Owing to the criss-crossing pattern, a number of rectangular openings or cavities 54 result. It will be noted that the ends of the rectangular openings 54 are formed by the parallel sides 50*a* of two adjacent ribs 50. Actually, the length of each opening or cavity 54 is equal to the distance between the triangular ends 24 and 26 of the various prismatic blocks 16.

In practice, the ribs 50 have a width of $\frac{1}{8}$ inch, whereas the flat upper surfaces of the ribs 52 have a width of $\frac{3}{8}$ inch at the top and 7/16 inch at the bottom, as measured between the lower edges of the angled sides 52*a* of a single rib 52. It is to be appreciated that the sides 52*a* incline at an angle of 60° with respect to each other so as to conform to the 60° angulation of the faces 18, 20 and 22. Because the ribs 50 have a width of $\frac{1}{8}$ inch, it follows that when various prismatic blocks 16 are placed in the openings 54, the ends 24, 26 of adjacent blocks will be spaced $\frac{1}{8}$ inch from each other. The ribs 52, by reason of their width and the sloping or angled sides 52*a* of adjacent ribs 52, maintain the particular face 18 or 20 that is uppermost when the blocks 16 are placed in the openings 54 in a raised relationship to the general plane of the grid 10. The ribs 52, because of their width, maintain the various faces 18 or 20, as the case may be, a distance of $\frac{1}{8}$ inch from each other when oriented in the direction of the ribs 50.

Centrally located in the grid 10 is a readily discernible wedge-shaped pocket 56 having sloping side walls 56*a* which form an apex at 56*b*. Additionally, the opposite ends of the pocket 56, which possess a triangular configuration, are labeled 56*c*. Inasmuch as the pocket 56 is intended to accommmodate one of the prismatic blocks 16, the side walls 56*a* are at 60° with respect to each other.

Additionally, the grid 10 includes four walls 58 at the grid's perimeter that slope or incline downwardly and outwardly. In this regard, the upper edge labeled 58*a* is in the same plane as the upper surfaces of the ribs 50 and 52, whereas the lower edges identified by the reference numeral 58*b* reside in the same plane that contains the bottom apex 56*b* of the centrally disposed pocket 56.

Figure 2:
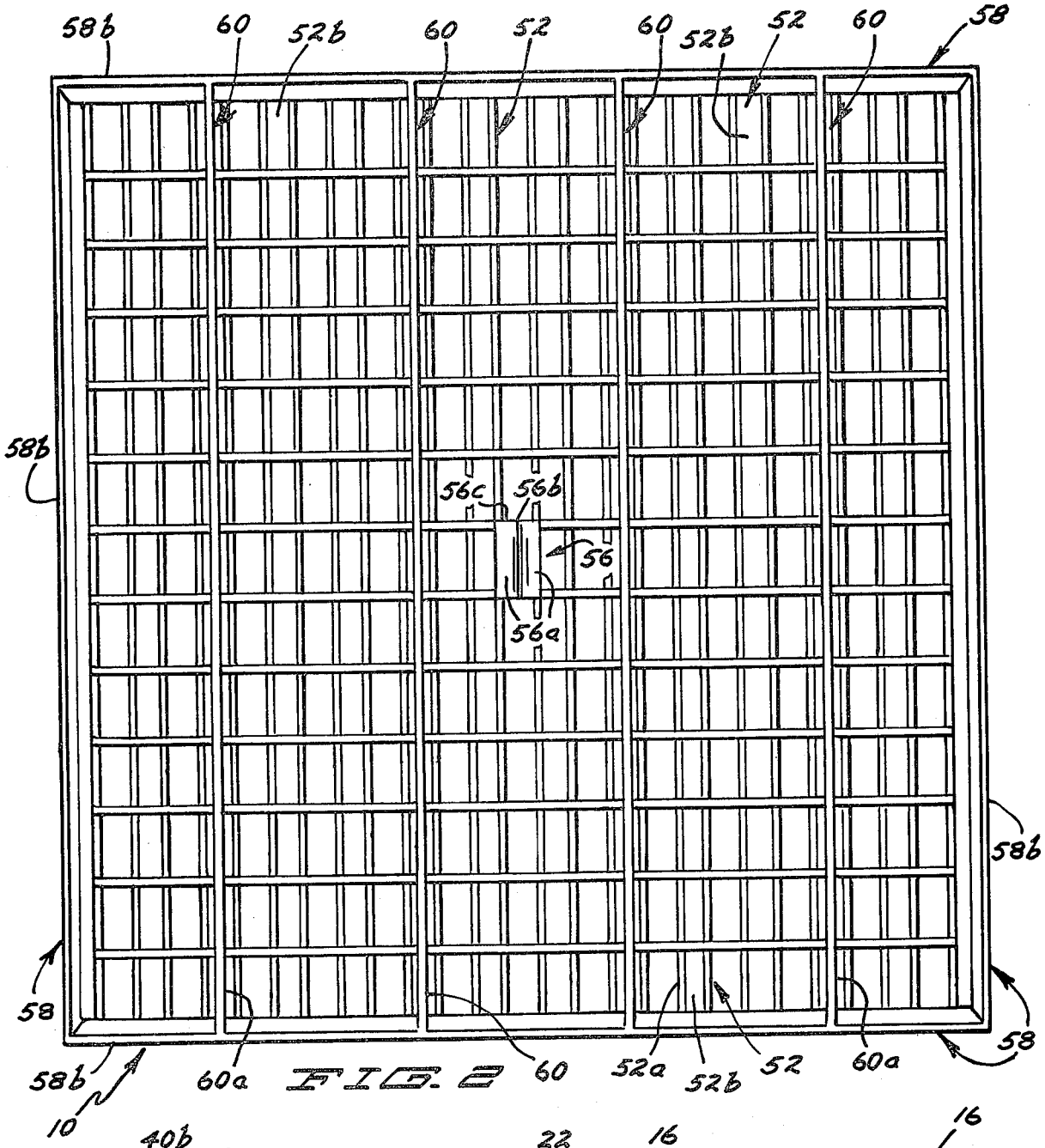
FIG. 2 is a bottom view of the grid without the racks.
Figure 5:
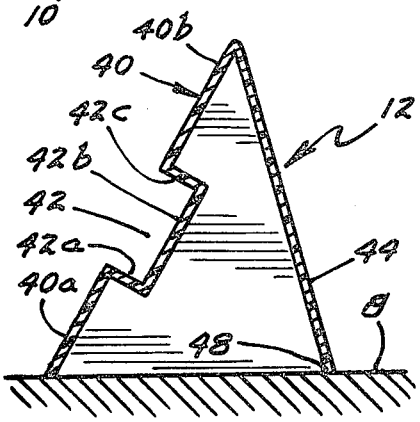
FIG. 5 is an enlarged cross-sectional view taken in the direction of 5—5 of one of the racks of FIG. 1.

Four of the ribs 52, as can be seen from FIG. 2, have underlying reinforcing ribs 60. These ribs extend in a parallel relationship with each other and are joined to the two opposite outer walls 58. The upper edges of the ribs 60 are integral with the particular ribs 52 which they underlie and the ends thereof are integrally joined to the inner sides of those outer walls 58 to which the ribs 52 are joined. The lower edges 60*a* of the ribs 60 reside in the same plane as the apex 56*b* and the lower edges 58*b*.

The above-described construction of the grid lends itself to fabrication by injection molding techniques, using a suitable plastic.

Figure 6:
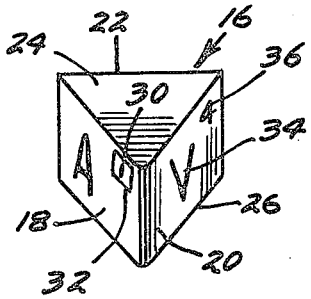
FIG. 6 is a perspective view of one of the prismatic blocks or playing pieces for the purpose of showing the two faces thereof having letters and scoring values thereon.
Figure 7:
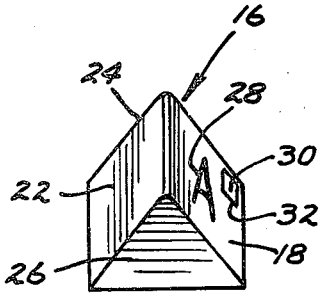
FIG. 7 is another perspective view but showing only one face having a letter and scoring number thereon, the view showing the third or blank side that is not visible in FIG. 6.
Figure 9:
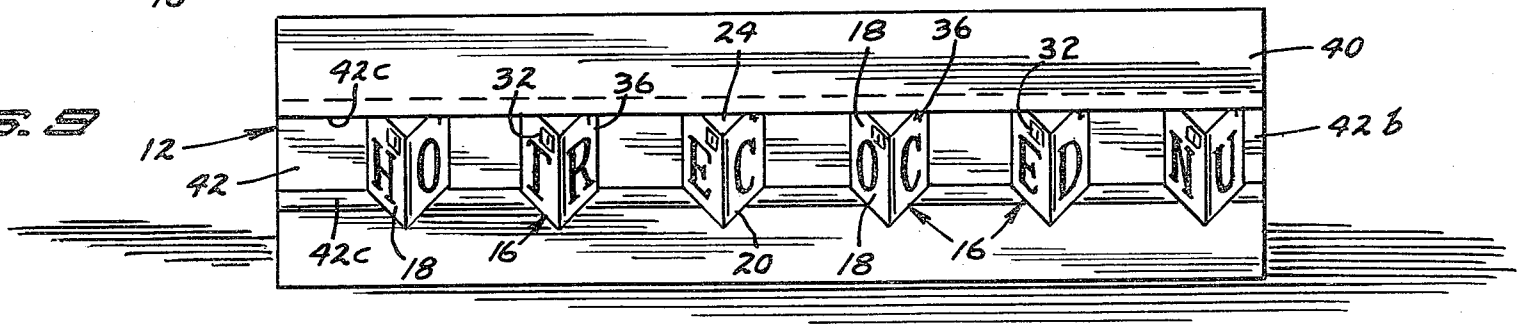
FIG. 9 is a front view of one of the racks of FIG. 1 with six of the blocks of FIG. 8 positioned thereon prior to placing them on the grid.
Figure 10:
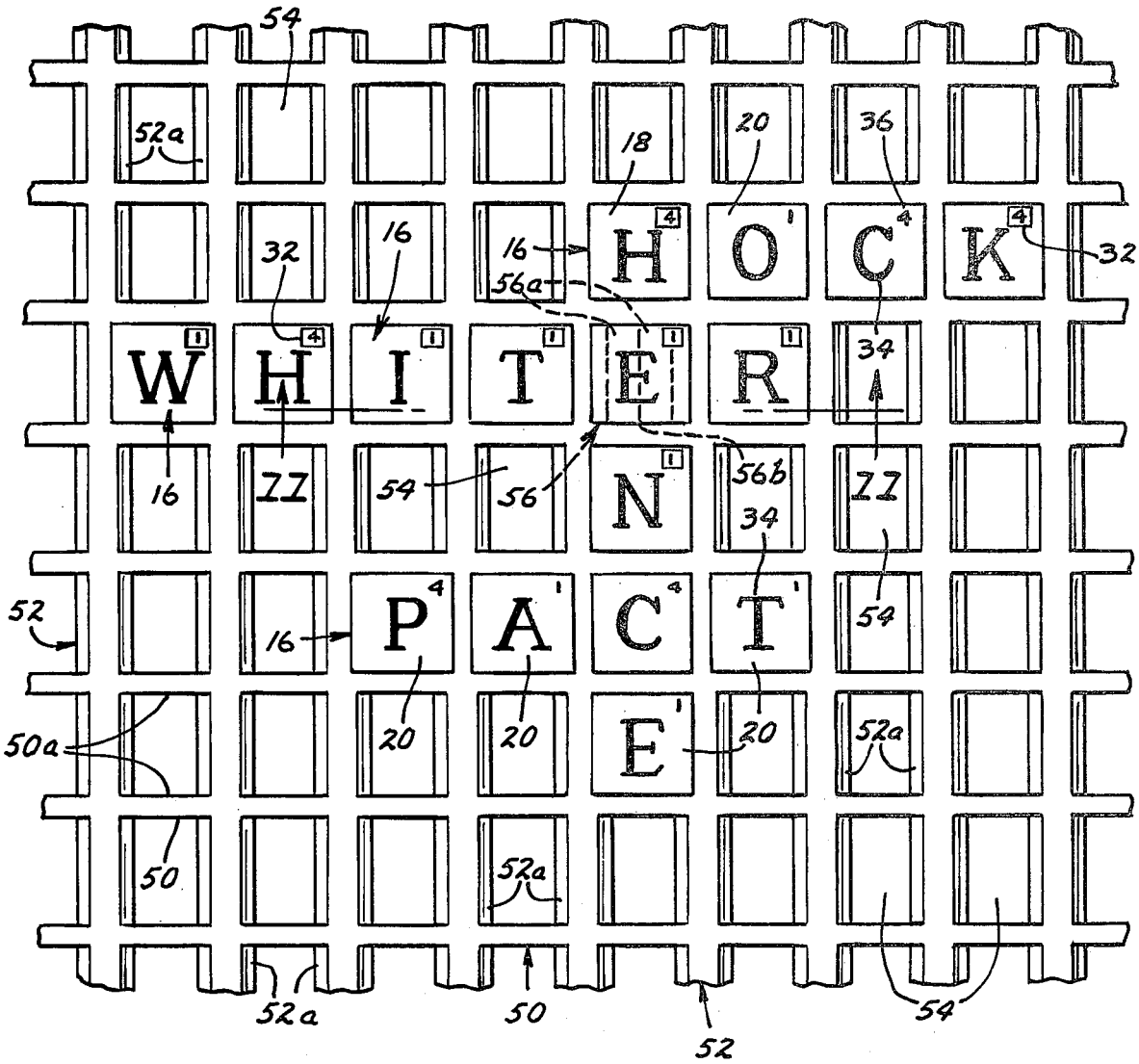
FIG. 10 is an enlarged fragmentary plan view of a portion of FIG. 1 with several words formed thereon, one being a six-letter word with all of the numerical values shown with a box encircling them and the other word being a mixture of both boxed and unboxed numerals.
Figure 11:
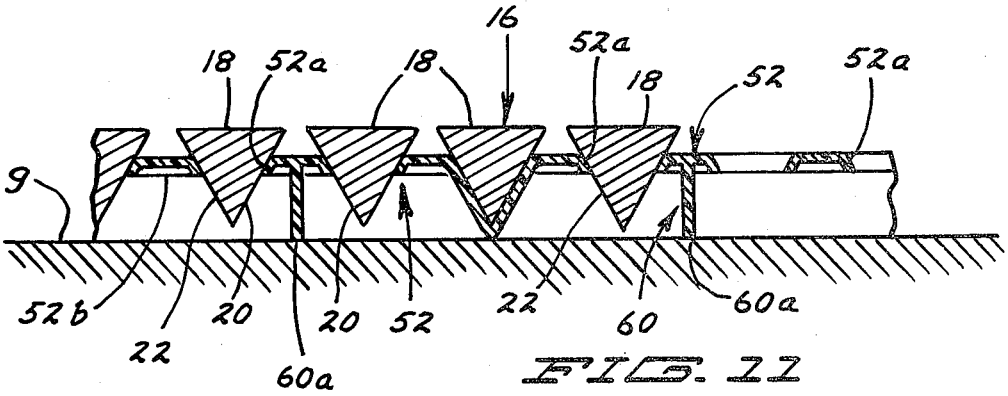
FIG. 11 is a sectional view similar to FIG. 3, but taken in the direction of line 11—11 of FIG. 10, the view thereby including some of the blocks appearing in FIG. 10.
Figure 12:
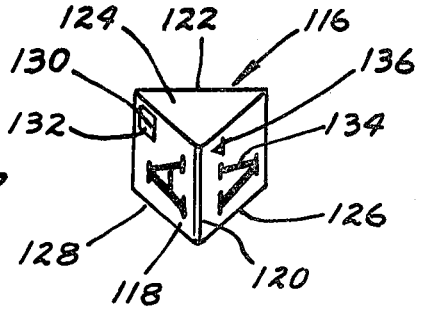
FIG. 12 is a view similar to FIG. 6, but depicting a playing block with its letters and scoring numerals turned through 90° with respect to the orientation illustrated in FIG. 6.
Figure 13:
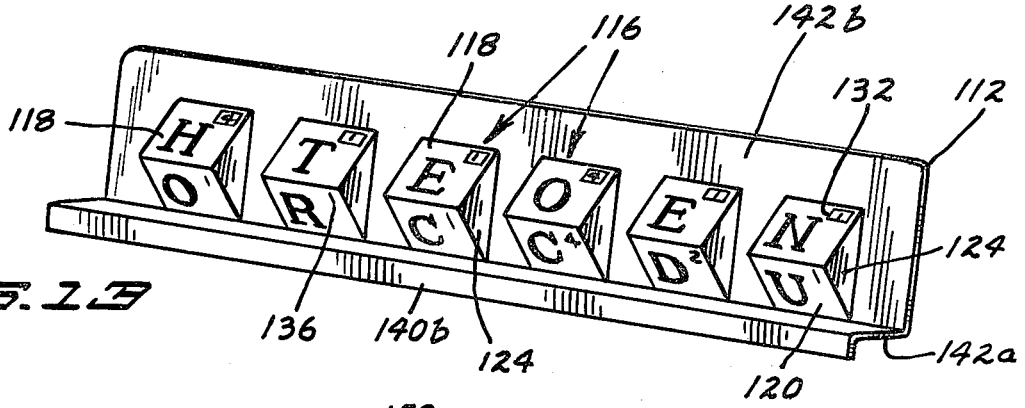
FIG. 13 is a view similar to FIG. 9, but in perspective so as to show a modified rack with the letters and numerals shown in FIG. 13 rotated through 90° as in FIG. 12.
Figure 14:
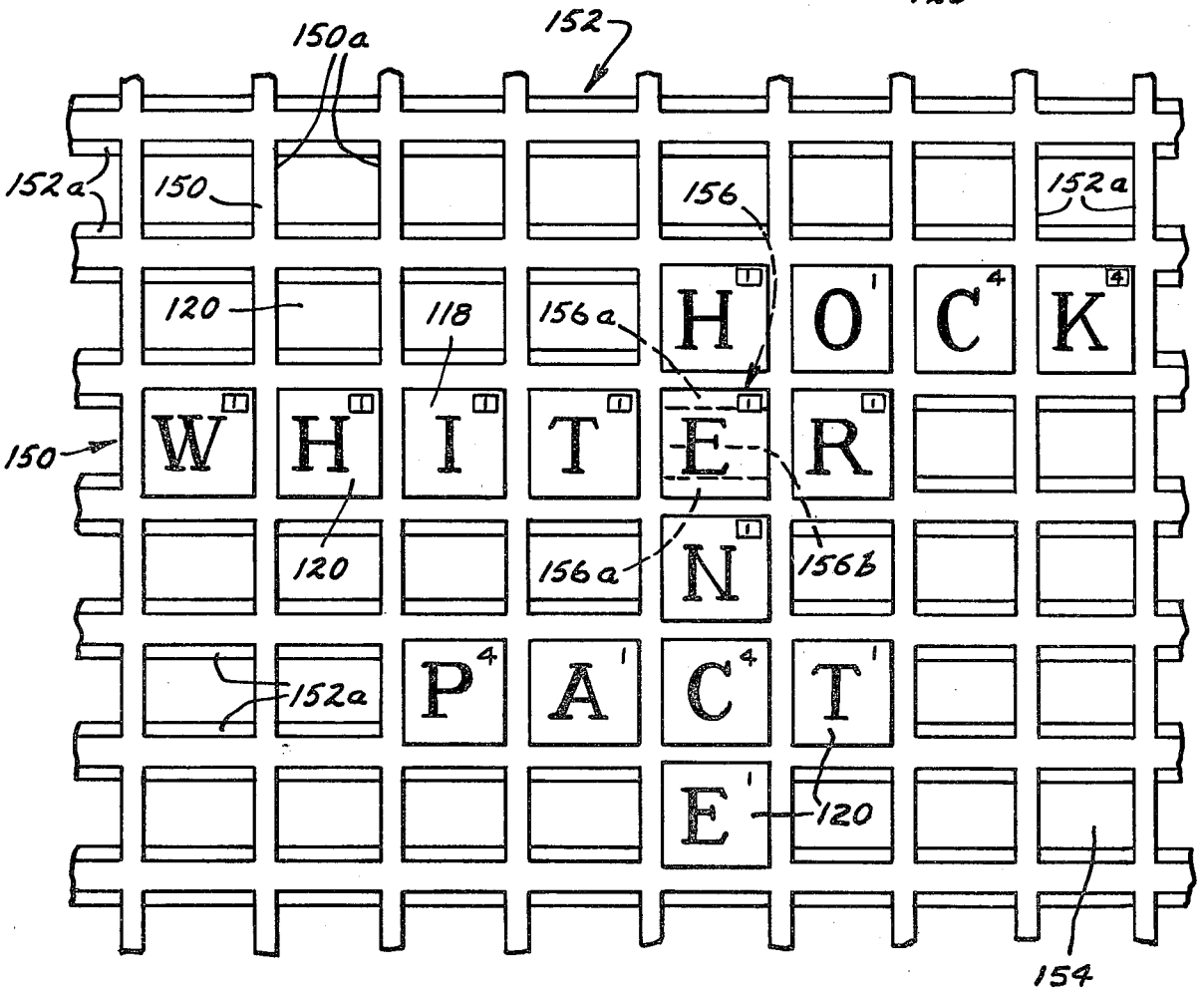
FIG. 14 is a view resembling FIG. 10, but with the grid turned through 90° so as to accommodate blocks with the letters rotated as in FIGS. 12 and 13.

With the foregoing in mind only a brief consideration of FIGS. 12–14 is needed, those figures constituting a slight physical modification of the arrangement pictured in FIGS. 6, 9 and 10, respectively. Owing to the close similarity, the prefix "1" will be added to those reference numerals appearing in FIGS. 12–14 in order to denote corresponding parts.

With the above in mind, it will be noted that the letters 128 and 134 in FIG. 12, as are the scoring numerals 130 and 136 are oriented at right angles with respect to the way they appear in FIG. 6.

The simplified rack shown in FIG. 13 has been denoted by the reference numeral 112 having a low sloping front wall 140 with a ledge 142*a* extending to a rear or back wall 142*b*. As will be immediately perceived from FIG. 13, the blocks 116 rest on one of their angled edges, more specifically the edge formed by the intersecting faces 118 and 120. It will be appreciated that the wall 142*b* angles rearwardly sufficiently so that the player can see both faces 118 and 120 at the same time. It will be understood that the rack 112 may be used to support either the blocks 116 or 16.

When using the blocks 116, one would also turn the grid 10 through 90° if the player at the south in FIG. 1 is to view the letters as he would view them in FIG. 10. While the construction of the grid 110 is not physically different, nonetheless it may facilitate an understanding of FIGS. 12 and 13 to also add the prefix "1" in FIG. 14.

Playing Method

As previously indicated, our word game is for two, three or four players, and, if desired, even by a single player. The objective is to form interlocking words in a cross-word manner. This is accomplished by first placing all of the prismatic blocks 16, 116 in the bag 14. To determine who plays first, it is intended that each player withdraw a block 16, 116 from the bag 14 and the one having the highest total score (determined by adding both numerals 30 or 130 and 36 or 136 appearing on the pair of faces 18 or 118 and 20 or 120) starts the game. The initially withdrawn blocks 16, 116 are returned to the bag 14 and the bag 14 is then shaken.

After mixing the various blocks 16, 116 contained in the bag 14, each player then draws six new blocks 16, 116 and places them on the ledge 42*a*, 142*a* of his particular rack 12, 112. More specifically, he orients the various blocks 16 so that the triangular end 26 rests on the bottom ledge 42*a* of the groove 42 and the back face 22 against the rear side 42*b* of the groove 42 or the edge formed by the angled faces 120, 122 and the back face 122 against the rear wall 142*b*. It is important to recognize that by positioning the six prismatic blocks 16, 116 he has taken from the bag 14 in the manner just described, both of the faces 18, 118 and 20, 120 are visible simultaneously. By having both faces 18, 118 and 20, 120 visible at the same time, together with whatever letters 28, 128 and 34, 134 are on these particular faces as well as the scoring exponents or numbers 30, 130 and 36, 136 the player can make a choice which will provide him with the best utilization of these particular letters and also the best use of the numerical scores associated therewith, all as will be better understood as the description progresses.

It will be recalled that each player withdraws six blocks 16, 116 from the bag 14 and places them on his rack 12, 112. For the sake of discussion, it will be assumed that the player at the west or to the left in FIG. 1 is the first to play. This means that the player at the top or north will be second, the player at the right or east will be third, and the player at the bottom or south will be last. Inasmuch as each player draws six blocks 16, 116 from the bag 14, there will be a total of twenty-four removed blocks 16, 116.

In this regard, the top row of blocks 16 appearing in FIG. 8 can be deemed to be the six drawn by the player at the west, the second row of six blocks 16 to be drawn by the player at the north, the third row of six blocks 16 drawn by the player at the east, and the bottom row of blocks 16 initially drawn by the player at the south. Of course, each row of blocks 16 in FIG. 8 would actually be placed in the players' racks 12; it is only to facilitate an understanding of the game that the rows are grouped together, as they are in FIG. 8. Furthermore, while in actual practice the faces 18 and 20 are at 60° with respect to each other, these faces in FIG. 8 are shown in a single plane; in other words, the faces 18 and 20 have been developed from their angular relationship into a planar relationship in order not to distort the various letters 28 and 34 thereon, and also so as not to distort the various numerals 30 and 36 to be used later in scoring.

It will further be assumed that the first player, who is the player at the west, can form the word "HENCE" and does so by placing the block 16 having the letter "E" thereon in the central pocket 56 (labeled 156 in FIG. 14 when using the blocks 116). The first player must be able with the blocks 16 he has withdrawn (those shown in the top row of FIG. 8 and also in FIG. 9) from the bag 14 form a word having at least four letters therein. Under the circumstances, he has been able to form a five-letter word. It will be observed, though, that the word "HENCE" is composed of letters having both boxed numerals 32 and unboxed numerals 36. Even if the numerals were all boxed or all unboxed, the word is too short to allow him any bonus points. Therefore, in determining the first player's score, he is entitled to add only the numerical values without any bonus added thereto. The score, which is eleven, is written down for that first player.

While the second player, that is the player at the north, has a choice of several letter combinations, he has found that it behooves him to spell the word "WHITER", using the "E" on the particular block 16 that has been inserted in the central pocket 56 by the first player at the west. It will be noted that all of the numerals have boxes 32 therearound. Consequently, the player at the north receives what is called an exponent pattern bonus which is 25 points for forming a word of six or more letters with all of the numbers in boxes 32. The same bonus pattern would be accorded to this same player if he used letters having all numbers without boxes. The same bonus pattern applies only to words containing six or more letters, either with or without boxed exponents. Consequently, while the player at the north might form the word "CHEW", giving him 13 points, he would not receive any bonus points. Therefore, his selection of "WHITER" is a better choice, for he receives 37 points (12+25).

As for the third player, this being the player at the east, he is only able to form the word "PACT". While all of his numbers 36 in this word are unboxed, he has not formed a word having six or more letters therein. Therefore, he is entitled to only the arithmetical sum of the numerals 36 appearing in association with the four letters of the word he has formed.

It should be pointed out that each player completes his turn by counting and announcing his score which is tallied on a pad of paper. The first player, this being the player at the west, would draw five new blocks 16 from the bag 14 to replace the five that he has used in spelling the word "HENCE". Although the second player, who is seated at the north, spells a six letter word, nonetheless he has used only five of his blocks 16, so he draws five more blocks 16 from the bag 14 to replace those that he has used. The third player, who is at the east, has used only three of his blocks 16, so he replaces the three with additional ones taken from the bag 14.

The fourth player, this being the player seated at the south, has not yet played. It will be recognized that he can spell several words, including the word "NOISE" or the word "HOUSE". However, he has selected the word "HOCK" which gives him a count of thirteen—more points than either "NOISE" (only five) or "HOUSE" (only eight) would provide. Additionally, the fourth player receives two more points for the vertically oriented "OR". If he had spelled "HOUSE", he would still receive the two points for "OR"; if he had gone the "NOISE" route, then he would receive three more points for the resulting vertically arranged "ROT". It should be obvious from the above that he helped himself the most by spelling "HOCK", receiving a total of fifteen points (thirteen for "HOCK" plus two for "OR"). With "NOISE", he would have received a total of eight points (five for "NOISE" and three for "ROT"), whereas for "HOUSE" he would have received a total of ten points (eight for "HOUSE" plus two for "OR").

One might wonder why the player at the south would not use the star or "*", declaring it as a "D" (both being on his rack 12) and the "E" to form the word "HOCKED", because he has the choice of having the asterisk or star stand for any letter he wants. However, he would only increase his score by "1" to a total of fourteen because the asterisk has no point value. It is better for the fourth player to save the block with the "*" and also the "B" in that the use of either face later would be likely to bring him a more optimum or higher point count. It must be borne in mind that once the block 16 with the asterisk thereon is played and the desired letter called, there can be no change of that letter. Furthermore, the "B" and its count of four would also be lost.

Having presented an illustrative play of four turns (described mainly with respect to the use of the blocks 16), the rules can now be better understood. At any time, the particular player whose turn has arrived can make a choice as to either of which letters appear on the pair of faces 18, 118 and 20, 120 with respect to each and every block 16, 116 of the six blocks that he has before him at any given time. He must form a word either in one row across or in one row down on the grid 10. The letters must form one full word and should they touch other letters, as in the playing example just presented, they, too, must form complete words in a cross-word manner. The player gets the full score for all words formed by him as well as those words he modifies during his particular play.

Consequently, any new words can be formed by adding one or more letters to a word or letters on the grid 10. He can also create a word at right angles to a word already on the grid 10. In this instance, the player must use one of the letters of the word that has already been formed on the grid 10 or he must add a letter to that word. He can form a word parallel to a word already appearing on the grid as long as the parallel word is connected by joining letters to the word that it parallels.

It is axiomatic that no block 16, 116 may be shifted after it has been inserted in any of the openings 54 or in the single control pocket 56. Hence, the player must carefully consider what blocks 16 he uses and which face 18 or 20 thereon he makes use of, for by properly selecting and positioning the letters on the faces 18, 20 he can increase the point value that he realizes, needlessly sacrificing points if his judgment is poor.

It should be pointed out that two of the prismatic blocks 16 (as would two of the blocks 116) contain the asterisk or star 38 thereon. In one situation, the asterisk or star 38 is on the left face 18 (see FIG. 8 and the tabulation) and in the other case the asterisk or star is on the right face 20 (see the tabulation). As already explained, the face 18 with the asterisk or star 38 thereon or the face 20 with the asterisk or star 38 thereon may be used as any desired letter; all that is required is that when the player having such a choice exercises the choice, he must announce what letter the asterisk or star represents. Once having stated what letter it is to represent, then the player cannot later change the letter. In other words, the letter, once announced, can only be the letter that has been mentioned. It is the player's decision, when he has an asterisk or star block, as to when he would derive the greatest benefit from its use.

At times, a player will find that the collection of blocks 16, 116 he has on his rack 12, 112 will not permit good selections to be made. He then can, if he wishes, replace all of the blocks 16 that are on his particular rack 12, but he sacrifices his turn in doing so. When he exercises this prerogative, he simply returns the various prismatic blocks 16 that he has on his rack 12 to the bag 14, drawing the same number of blocks 16 from the bag 14, placing the new blocks 16 on his rack 12, and then awaiting his next turn to play. Stated somewhat differently, he cannot use any of the blocks he has just taken from the bag 14 until his turn again arrives, which is only after each other player has completed his play.

As with most word games, it is intended that only standard dictionary words be accepted; capitalized words are precluded, those designated as foreign words, as well as abbreviations, and also words which necessitate the use of apostrophes or hyphens. Any player may challenge a word before the next player begins his play. If the word that is challenged is not a proper word, then the challenged player must take back all of the blocks 16 that he has used in the unacceptable word, in addition, losing his turn.

While four plays have been described, it will be appreciated that the game continues until all of the blocks 16, 116 have been drawn with one of the players having used all of the blocks 16, 116 on his rack 12, 112. If it should turn out that there are no further possible plays to be effected, then this will also end the game.

Our invention provides a word game that is quite versatile and challenging. Not only does the player have choices as to which block 16, 116 he uses, but he is confronted with the additional decision as to whether to use the letter on the face 18, 118 or the letter on the face 20, 120. Additionally, he must keep in mind that he wants to attain the highest possible score that he can. In this regard, the score for each turn is based on combinations of any of four possible scoring phases:

(1) The basic word score which is the sum of the numerals 28 or 36 associated with each exposed letter 28 or 34 of whatever newly formed word appears on the grid 10.

(2) The length multiplier; although up to this time not yet mentioned, is a premium for the creation of longer words. A player doubles the basic word score when he creates a word of six or more letters.

(3) The exponent or numerical pattern bonus; already alluded to is a bonus for the creation of longer words with letters possessing the same boxed or unboxed numerical pattern. The premium assigned is worth 25 points for a word having six or more letters therein.

(4) The depleted rack premium has not been mentioned but is a reward for playing all six blocks 16 in a single turn. A player who is successful in doing this receives an additional 25 point premium.

It will be understood that when two or more words are formed in the same play, each word is scored in accordance with the numerical values assigned to the letters constituting the two or more words. The numerical value for the common letter is counted in the score for each word.

Still further, at the end of the game, each player's score is reduced by the sum of the exponents or numbers of his unplayed blocks 16, 116 both the numeral 30, 130 on the face 18, 118 and numeral 36, 136 on the face 20, 120 being added together, and the sum then subtracted from whatever score the player otherwise has derived from the formation of words.

In most cases, the game will end by one player using up all of his blocks 16, 116 and when this occurs, his score is increased by the sum of the unplayed numerals or exponents 30, 130, 36, 136 of all of the other players. As earlier herein explained, the play continues until either all of the blocks 16, 116 have been drawn and used, which is the condition that enhances the player's score as just mentioned, but the game can end by all of the possible plays having been made. In this latter situation, the score, quite obviously, of any player is not increased.

From the foregoing, it is believed evident that our word game entails a considerable degree of skill, not only in the forming of various words but forming words in such a manner that the player obtains the highest possible score. Although not wholly eliminated, the element of chance is appreciably reduced when playing our game, for the final point count depends upon the skill and experience of the players in formulating word strategies that will provide them with the highest possible score at the end of the game.

We claim:

1. A word game comprising a plurality of prismatic blocks, each having first, second and third acutely angled rectangular faces and triangularly configured parallel end faces with a letter on each of said first and second faces, and planar means for supporting a number of said blocks in intersecting rows, said supporting means including first and second criss-crossing members forming rectangular openings, said first members having a greater spacing therebetween than said second members so that said rectangular openings have one dimension greater than the other to orient said blocks so that only selected first or second faces of said blocks are simultaneously visible to a group of player.

2. A word game in accordance with claim 1 in which said third face is devoid of any letter.

3. A word game in accordance with claim 2 including means for initially supporting a number of said blocks so that said first and second faces are simultaneously visible to a player.

4. A word game in accordance with claim 1 in which said letters are centrally located on said first and second rectangular faces and said first and second rectangular faces additionally have a number in one corner thereof for scoring purposes.

5. A word game comprising first means for initially holding a plurality of blocks having a pair of acutely angled rectangular faces and a third rectangular face, each of said pair of faces having a letter thereon, so that said pair of faces and the letters thereon are both visible, said first means engaging only said third faces to permit any one of said blocks to be individually removed from said first means and second means for subsequently holding said individually removed blocks in intersecting rows so that only one of said pair of faces and the letter thereon of each block is visible, said second means including a planar grid having a plurality of rectangular openings having one lateral dimension greater than the other to orient said blocks and to enable only one of said pair of faces of each block and the letter thereon to be exposed to view.

6. A word game in accordance with claim 5 in which said first means includes a rack having a sloping front wall, said sloping front wall having a horizontal ledge extending thereacross on which said blocks are held so as to expose to view their said pair of faces and the letters thereon.

7. A word game in accordance with claim 5 in which said blocks have a prismatic configuration forming said pair of rectangular faces and a third unlettered or blank rectangular face, said rectangular faces being arranged at 60° with respect to each other, and said openings in said grid having a size so that said blocks can be inserted in said openings with one of said pair of faces and the letter thereon directed upwardly, and the other of said pair of faces together with the letter thereon, and said third face, directed downwardly when said grid resides in a generally horizontal plane.

8. A word game in accordance with claim 5 in which said first means includes a rack having a horizontal ledge, a downwardly sloping panel at the front of said ledge, and an upwardly sloping panel at the rear of said ledge, some of said blocks being supported in a row on said ledge so that said pair of faces and the letters thereon are simultaneously exposed to view.

9. A word game comprising a plurality of blocks having a prismatic configuration forming a pair of acutely angled faces and a third face, said faces being arranged at 60° with respect to each other, each of said pair of faces having a letter thereon and said third face being unlettered or blank, first means for initially holding some of said blocks so that said pair of faces are both visible, and second means including a grid having a plurality of openings therein having a size so that said blocks can be inserted in said openings with only one of said pair of faces directed upwardly and exposed to view, and the other of said pair of faces and said third face directed downwardly when said grid resides in a generally horizontal plane, said grid having a centrally located wedge-shaped pocket having downwardly sloping walls so as to receive one of said blocks.

10. A word game in accordance with claim 9 in which said grid includes downwardly extending walls at its perimeter, the lower edges of said perimetric walls terminating in the same plane with the lower edges of said sloping walls forming said wedge-shaped pocket.

11. A word game in accordance with claim 10 including perpendicularly intersecting ribs forming said openings and further including downwardly projecting ribs extending parallel to the lower edges of said wedge-shaped pocket, said downwardly projecting ribs underlying certain of said intersecting ribs.

12. A word game comprising a plurality of blocks having a prismatic configuration forming a pair of acutely angled faces and a third face, said faces being arranged at 60° with respect to each other, each of said pair of faces having a letter thereon and said third face being unlettered or blank, first means for initially holding some of said blocks so that said pair of faces are both visible, and second means including a grid having a plurality of openings therein having a size so that said blocks can be inserted in said openings with only one of said pair of faces directed upwardly and exposed to view, and the other of said pair of faces and said third face directed downwardly when said grid resides in a generally horizontal plane, said blocks having triangular end faces residing in parallel planes and in which said openings are rectangular with a length corresponding to the distance between said parallel planes, said grid including a plurality of perpendicularly intersecting ribs forming said openings, one set of said ribs extending in one direction and determining the distance between said parallel planes, and the other set of said ribs determining the distance between the width of said openings and being wider than the ribs of said one set so as to maintain the upwardly directed face of each block at an elevation above the plane of said grid, said other or wider ribs each having a sloping side so as to engage a longitudinal portion of each of the two downwardly directed faces of a block.

13. A word game in accordance with claim 12 in which said sloping sides are spaced from each other so as to maintain said blocks at said elevation so that the distance between the upwardly directed faces of adjacent blocks is substantially equal to the distance between the ends of adjacent blocks.

14. A word game comprising a plurality of blocks, each having first and second acutely angled faces with a relatively large letter and a relatively small number on each of said first and second faces, the first faces of said blocks assuming a positional relation with the second faces of said blocks when said blocks are correspondingly oriented, and identical means on each of said first faces distinguishing the first faces of said blocks from the second faces of said blocks so that said first and second faces can be visually identified irrespective of the orientation of said blocks to facilitate the assigning of bonus values when all of said first faces or all of said second faces of a number of said plurality of blocks are arranged in a row to form a word comprised of letters on said first faces or letters on said second faces.

15. A word game in accordance with claim 14 in which said distinguishing means constitutes a mark on each of said first faces proximally located relative to the number on that particular first face.

16. A word game in accordance with claim 14 including means for supporting any number of said plurality of blocks in intersecting rows with either said first or second faces and the letters thereon being visible.

17. A method comprising the steps of providing a plurality of prismatic blocks for a group of players, each block having first, second and third acutely angled rectangular faces and triangularly configured parallel end faces, the majority of said first and second faces also having a number thereon indicative of a value assigned to that face and the majority of said first faces also having additional means distinguishing said first face from said second face, randomly orienting all of said blocks to form a collection of mixed blocks, each player withdrawing a predetermined number of blocks from said collection of mixed blocks, each player arranging his withdrawn blocks in a row so that both said first and second faces are visible to him, one of said players forming a word having at least four letters therein by arranging the first and second faces of at least some of that player's blocks so that only said first or second faces are visible to all of said players, writing down the score of said one player as determined from the numerical values on the blocks he has arranged in a row to form a word, and a second of said players arranging at least some of his row of blocks in relation to the arranged row of blocks by said one player so as to include the word of said one player, said second player either extending the row of arranged blocks of said one player or arranging his row of blocks perpendicularly with respect to one of the letters of the row arranged by said one player.

18. The method of claim 17 in which each player initially withdraws a block from said collection of blocks to determine who is to be said one player, the numbers on both of said first and second faces determining said order, and returning said initially withdrawn blocks to said collection so that said subsequent number of withdrawn blocks may or may not include said initially withdrawn blocks.

19. A word game comprising a plurality of prismatic blocks, each having first, second and third acutely angled rectangular faces and triangularly configured parallel end faces with a letter centrally located on each of said first and second faces and said first and second rectangular faces additionally having a number in one corner thereof for scoring purposes, means on said first faces for distinguishing the numbers on said first faces from the numbers on said second faces, and means for supporting a number of said blocks in intersecting planar rows so that only selected first or second faces of said blocks are simultaneously visible to a group of players.

20. A word game in accordance with claim 19 in which the means on said first faces for distinguishing the numbers on said first faces each includes a mark closely associated therewith for distinguishing the numbers on said first faces from the numbers on said second faces.

21. A word game in accordance with claim 19 in which the means on said first faces for distinguishing the numbers on said first faces includes a box enclosing each number and in which the numbers on said second faces are unenclosed.

22. A word game in accordance with claim 19 in which said numbers are of smaller size than said letters.

23. A word game comprising a plurality of prismatic blocks, each having first, second and third acutely angled rectangular faces and parallel end faces having triangularly configured edges, said first and second faces each having a letter thereon, and a planar game board for holding said blocks, said game board having a plurality of elongated rectangular openings, the longer dimension of each opening corresponding to the distance between said triangularly configured end faces and the shorter dimension of each opening being less than the length of any of said triangularly configured edges, said game board thereby holding said blocks so that said blocks are readily removable and holding said blocks so that only said selected first or second faces are visible, the shorter dimension of each rectangular opening maintaining the first or second face of any block placed therein in a raised relation with respect to said planar board.

* * * * *